US010015860B2

(12) United States Patent
Datta et al.

(10) Patent No.: US 10,015,860 B2
(45) Date of Patent: Jul. 3, 2018

(54) METHOD AND APPARATUS FOR DETECTING PRESENCE OF DIMMER AND CONTROLLING POWER DELIVERED TO SOLID STATE LIGHTING LOAD

(75) Inventors: Michael Datta, Brookline, MA (US); Gregory Campbell, Walpole, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 917 days.

(21) Appl. No.: 13/639,880

(22) PCT Filed: Mar. 29, 2011

(86) PCT No.: PCT/IB2011/051334

§ 371 (c)(1),
(2), (4) Date: Jan. 4, 2013

(87) PCT Pub. No.: WO2011/128798

PCT Pub. Date: Oct. 20, 2011

(65) Prior Publication Data

US 2013/0193866 A1 Aug. 1, 2013

Related U.S. Application Data

(60) Provisional application No. 61/324,088, filed on Apr. 14, 2010.

(51) Int. Cl.

| | |
|---|---|
| ***H05B 37/02*** | (2006.01) |
| ***H05B 33/08*** | (2006.01) |
| ***H05B 39/08*** | (2006.01) |

(52) U.S. Cl.

CPC ..... *H05B 37/02* (2013.01); *H05B 33/0815* (2013.01); *H05B 39/08* (2013.01)

(58) Field of Classification Search

CPC ..... H05B 37/02
USPC ..... 315/291, 224, 247, 209; 323/320
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 6,369,517 | B2 * | 4/2002 | Song et al. | 315/194 |
| 7,256,554 | B2 * | 8/2007 | Lys | 315/291 |
| 7,291,988 | B2 * | 11/2007 | Hung | 315/291 |
| 8,547,034 | B2 * | 10/2013 | Melanson et al. | 315/247 |
| 8,558,518 | B2 * | 10/2013 | Irissou et al. | 323/237 |
| 8,569,972 | B2 * | 10/2013 | Melanson | 315/307 |
| 2002/0140373 | A1 * | 10/2002 | Ribarich et al. | 315/224 |

(Continued)

FOREIGN PATENT DOCUMENTS

WO 2009120555 A1 10/2009

*Primary Examiner* — Douglas W Owens
*Assistant Examiner* — Wei Chan
(74) *Attorney, Agent, or Firm* — Akarsh P. Belagodu

(57) ABSTRACT

A system and method control an amount of power delivered by a power converter (220) to a solid state lighting load (240). It is determined whether a dimmer (204) is present between a voltage source (201) and the power converter (220) based on a rectified input voltage from the voltage source. When the dimmer is determined to be present, an operating point of the power converter is adjusted to increase the amount of power delivered by the power converter to the solid state lighting load by a compensation amount, so that the increased amount of power is equal to an amount of power delivered by the power converter when the dimmer is not present.

11 Claims, 6 Drawing Sheets

(56) References Cited

U.S. PATENT DOCUMENTS

| | | | | |
|---|---|---|---|---|
| 2003/0080696 | A1* | 5/2003 | Tang et al. | 315/291 |
| 2007/0182347 | A1* | 8/2007 | Shteynberg et al. | 315/312 |
| 2009/0243582 | A1* | 10/2009 | Irissou et al. | 323/320 |
| 2009/0295300 | A1* | 12/2009 | King | 315/209 R |
| 2010/0127634 | A1* | 5/2010 | Dowling et al. | 315/291 |
| 2010/0148691 | A1* | 6/2010 | Kuo et al. | 315/291 |
| 2010/0164406 | A1* | 7/2010 | Kost et al. | 315/307 |
| 2010/0213859 | A1* | 8/2010 | Shteynberg et al. | 315/224 |
| 2011/0037399 | A1* | 2/2011 | Hung et al. | 315/219 |
| 2011/0080112 | A1* | 4/2011 | Shearer et al. | 315/291 |
| 2011/0121754 | A1* | 5/2011 | Shteynberg | H05B 33/0815 315/294 |

* cited by examiner

METHOD AND APPARATUS FOR DETECTING PRESENCE OF DIMMER AND CONTROLLING POWER DELIVERED TO SOLID STATE LIGHTING LOAD

TECHNICAL FIELD

The present invention is directed generally to control of solid state lighting fixtures. More particularly, various inventive methods and apparatuses disclosed herein relate to digitally detecting the presence of a dimmer in a solid state lighting system and correcting for power loss when a dimmer is present.

BACKGROUND

Digital or solid state lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference. LED technology includes line voltage powered white lighting fixtures, such as the ESSENTIALWHITE series, available from Philips Color Kinetics. These fixtures may be dimmable using trailing edge dimmer technology, such as electric low voltage (ELV) type dimmers for 120 VAC line voltages.

Many lighting applications make use of dimmers. Conventional dimmers work well with incandescent (bulb and halogen) lamps. However, problems occur with other types of electronic lamps, including compact fluorescent lamp (CFL), low voltage halogen lamps using electronic transformers and solid state lighting (SSL) lamps, such as LEDs and OLEDs. Low voltage halogen lamps using electronic transformers, in particular, may be dimmed using special dimmers, such as ELV type dimmers or resistive-capacitive (RC) dimmers, which work adequately with loads that have a power factor correction (PFC) circuit at the input.

Conventional dimmers typically chop a portion of each waveform of the input mains voltage signal and pass the remainder of the waveform to the lighting fixture. A leading edge or forward-phase dimmer chops the leading edge of the voltage signal waveform. A trailing edge or reverse-phase dimmer chops the trailing edges of the voltage signal waveforms. Electronic loads, such as LED drivers, typically operate better with trailing edge dimmers.

Unlike incandescent and other resistive lighting devices which respond naturally without error to a chopped sine wave produced by a phase-cutting dimmer, LED and other solid state lighting loads may incur a number of problems when placed on such phase chopping dimmers, such as low end drop out, triac misfiring, minimum load issues, high end flicker, and large steps in light output. In addition, even when a phase chopping dimmer is set to its highest setting in order to minimize the amount of dimming, the phase chopping dimmer still does not allow the full input mains voltage signal waveform to the input of a power converter, configured to deliver DC power to the LED or other solid state lighting load corresponding to the input mains voltage.

For example, FIG. 1A depicts waveforms of a rectified input mains voltage received by a power converter when a dimmer is connected between the voltage mains and the power converter, where the dimmer is set at its highest setting. FIG. 1B depicts waveforms of the received rectified input mains voltage when the power converter is connected directly to the voltage mains, without a dimmer (indicated by an "X" through the adjacent dimmer switch). As indicated by FIGS. 1A and 1B, the root mean square (RMS) voltage at the input to the power converter is slightly lower with a dimmer, as compared to the directly connected power converter. In other words, the power converter in the dimmable lighting system runs in a fashion that delivers less power with less RMS input voltage. As a result, power delivered to the solid state lighting load, even with the dimmer at its highest (no dimming) setting, is slightly less than the power delivered to the solid state lighting load without a dimmer.

SUMMARY

The present disclosure is directed to inventive methods and devices for correcting power loss by a solid state lighting load by detecting when a dimmer is present and selectively adjusting the operating point of a power converter to compensate for the power loss caused by the dimmer.

Generally, in one aspect, a method of controlling an amount of power delivered by a power converter to a solid state lighting load includes determining whether a dimmer is present between a voltage source and the power converter based on a rectified input voltage from the voltage source. When the dimmer is determined to be present, an operating point of the power converter is adjusted to increase the amount of power delivered by the power converter to the solid state lighting load by a compensation amount, so that the increased amount of power is equal to an amount of power delivered by the power converter when the dimmer is not present.

In another aspect, a system for controlling power delivered to a solid state lighting load includes a power converter and a dimmer presence detection circuit. The power converter is configured to deliver a predetermined nominal power to the solid state light load in response to a rectified input voltage originating from voltage mains. The dimmer presence detection circuit is configured to determine whether a dimmer is connected between the voltage mains and the power converter, to generate a power control signal having a first value when the dimmer is present and having a second value when the dimmer is not present, and to provide the power control signal to the power converter. The power converter increases output power by a compensation amount in response to the first value of the power control signal, the increased output power being equal to the nominal power.

In another aspect, a method is provided for controlling a power converter to deliver a predetermined nominal power to an LED light source corresponding to an input voltage from voltage mains, regardless of whether a dimmer is present in a circuit between the voltage mains and the power converter. The method includes detecting a phase angle based on signal waveforms of a rectified input voltage and comparing the detected phase angle with a predetermined threshold. When the detected phase angle is below the predetermined threshold, a power control signal is set to a dimmer value and provided to the power converter, causing the power converter to increase an output power to the predetermined nominal power and to deliver to the increased output power to the LED light source. When the detected phase angle is not below the predetermined threshold, the power control signal is set to a no dimmer value and provided to the power converter, causing the power converter to deliver an output power to the LED light source without increasing the output power, where the output power is equal to the predetermined nominal power.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., LED white lighting fixture) may include a number of dies which respectively emit different spectra of electroluminescence that, in combination, mix to form essentially white light. In another implementation, an LED white lighting fixture may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white light LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide a circuit capable of detecting the presence of a dimmer in a lighting system, and compensating for power loss when a dimmer is present. Generally, it is desirable to have the same amount of light output from a solid state lighting load, regardless of whether it is directly connected to voltage mains with no dimmer present or is connected to a dimmer set to its highest setting. Otherwise, users may measure or otherwise perceive that light output from the solid state lighting load of a circuit with a dimmer is consistently lower than the specified amount and/or lower than light output from the solid state lighting load of a circuit not including the dimmer. Likewise, when a dimmer is present, its dimming range (i.e., the difference in the amount of light output between the highest and lowest dimmer settings) increases when the amount of light output at the highest dimmer setting is corrected to compensate for the presence of the dimmer.

Figure 2:
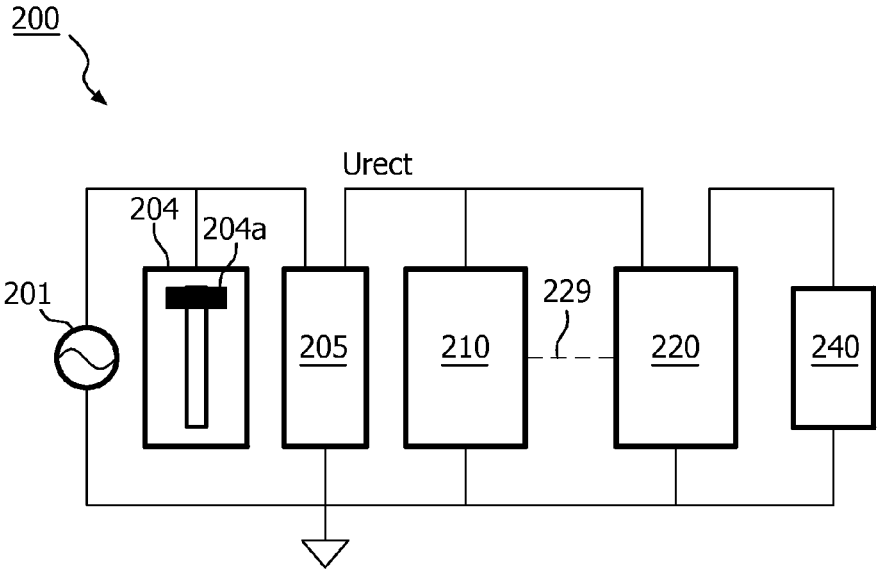
FIG. 2 is a block diagram showing a dimmable lighting system, according to a representative embodiment.

FIG. 2 is a block diagram showing a dimmable lighting system, including a dimmer presence detection circuit, a power converter and a solid state lighting fixture, according to a representative embodiment. Referring to FIG. 2, lighting system 200 includes dimmer 204 and rectification circuit 205, which provide a (dimmed) rectified voltage Urect from voltage mains 201. The voltage mains 201 may provide different unrectified input mains voltages, such as 100 VAC, 120 VAC, 230 VAC and 277 VAC, according to various implementations. The dimmer 204 is a phase chopping dimmer, for example, which provides dimming capability by chopping trailing edges (trailing edge dimmer) or leading edges (leading edge dimmer) of voltage signal waveforms from the voltage mains 201 in response to vertical operation of its slider 204*a*. Generally, the magnitude of the rectified voltage Urect is proportional to a phase angle set by the dimmer 204, such that a lower phase angle (corresponding to a lower dimmer setting) results in a lower rectified voltage Urect. In the depicted example, it may be assumed that the slider 204*a* is moved downward to lower the phase angle, reducing the amount of light output by solid state lighting load 240, and is moved upward to increase the phase angle, increasing the amount of light output by the solid state lighting load 240. The phase angle is therefore greatest when the slider 204*a* is at its highest setting, as depicted in FIG. 2.

The lighting system 200 further includes dimmer presence detection circuit 210 and power converter 220. The dimmer presence detection circuit 210 is configured to determine whether a dimmer, such as representative dimmer 204, is present (or absent) in the circuit based on the rectified voltage Urect. The power converter 220 receives the rectified voltage Urect from the rectification circuit 205, and outputs a corresponding DC voltage for powering the solid state lighting load 240. The power converter 220 converts between the rectified voltage Urect and the DC voltage based on at least the magnitude of the rectified voltage Urect and a power control signal received form the dimmer presence detection circuit 210, discussed below. DC voltage output by the power converter 220 thus reflects the rectified voltage Urect and the phase angle (i.e., the level of dimming) applied by the dimmer 204. In various embodiments, the power converter 220 operates in an open loop or feed-forward fashion, as described in U.S. Pat. No. 7,256,554 to Lys, for example, which is hereby incorporated by reference.

As stated above, there is always some level of phase chop caused by the dimmer 204 when it is present in the circuit, even when the dimmer 204 is at its highest dimmer setting (corresponding to no dimming or the highest level of light output while a dimmer is connected). Accordingly, there is a decrease in RMS voltage seen at the input to the power converter 220 when the dimmer 204 is present. In the absence of compensation, the decreased RMS voltage would decrease the amount of power delivered by the power converter 220 to the solid state lighting load 240, resulting in a decreased maximum light output. Therefore, the dimmer presence detection circuit 210 is configured to control the power converter 220 to add a compensation amount to the power delivered to the solid state lighting load 240, so that the maximum light output by the solid state lighting load 240 is the same when the dimmer 204 is present as otherwise would be output when the dimmer 204 is not present.

In other words, if the dimmer 204 were not present, the voltage mains 201 would be connected directly to rectification circuit 205, and the rectified voltage Urect supplied to the power converter 220 would be the full rectified input mains voltage. Also, an operating point of the power converter 220 would be set to output a nominal power corresponding to the input mains voltage. In comparison, when the dimmer 204 is present, the dimmer presence detection circuit 210 detects the dimmer 204 and adjusts the operating point of the power converter 220, so that a compensation amount is added to the output power, compensating for the power loss introduced by the dimmer 204. Accordingly, the amount of power delivered to the solid state lighting load 240 is equal to the nominal power that would be output by the power converter 220 if the dimmer 204 were not present.

In various embodiments, the dimmer presence detection circuit 210 detects a phase angle (of the dimmer 204) based on the rectified voltage Urect, and compares the detected phase angle to a predetermined upper threshold. Generally, when the detected phase angle is below the threshold, the dimmer presence detection circuit 210 determines that a dimmer is present, and when the detected phase angle is above the threshold, the dimmer presence detection circuit 210 determines that a dimmer is not present, as discussed below. Of course, the dimmer presence detection circuit 210 may detect the presence (or absence) of a dimmer by various alternative means, without departing from the scope of the present teachings.

The dimmer presence detection circuit 210 outputs a power control signal, e.g., via a control line 229, to the power converter 220 that dynamically adjusts the operating point of the power converter 220, as discussed above. For example, the dimmer presence detection circuit 210 may set the power control signal to one of two levels. A first level (e.g., voltage low) may indicate that no dimmer is present, in which case the power converter 220 outputs a nominal power based on the input mains voltage. A second level (e.g., voltage high) may indicate that a dimmer (e.g., dimmer 204) is present, in which case the power converter 220 outputs power based on the input mains voltage plus a compensation amount having a value that compensates for the power loss to the solid state lighting load 240 introduced by the presence of the dimmer 204 in the circuit. Thus, the power delivered to the solid state lighting load 240 is determined by the RMS input voltage and the power control signal.

In various embodiments, the power control signal may be a pulse width modulation (PWM) signal, for example, rather than merely a continuous high or low digital signal. The PWM signal alternates between high and low levels in accordance with a predetermined duty cycle, based on the presence of a dimmer. For example, the power control signal may have a first duty cycle indicating that no dimmer is present, in which case the power converter 220 outputs the nominal power based on the input mains voltage. The first duty cycle may be a zero percent duty cycle, for example, which is a continuous voltage low signal, as discussed above. The power control signal may have a second duty cycle indicating that a dimmer is present, in which case the power converter 220 outputs power based on the input mains voltage plus the compensation amount. The second duty cycle may be a 100 percent duty cycle, for example, which is a continuous voltage high signal, as discussed above.

Further, when the dimmer 204 is in the circuit and the dimmer 204 is set below the high setting, the dimmer presence detection circuit 210 may further determine a duty cycle of the power control signal that specifically corresponds to the actual detected dimmer phase angle, further controlling the output power of the power converter 220. The duty cycle may range from zero percent to 100 percent, including any percentage in between, for example, in order to adjust appropriately the power setting of the power converter 220 to control the level of light emitted by the solid state lighting load 240.

Figure 3:
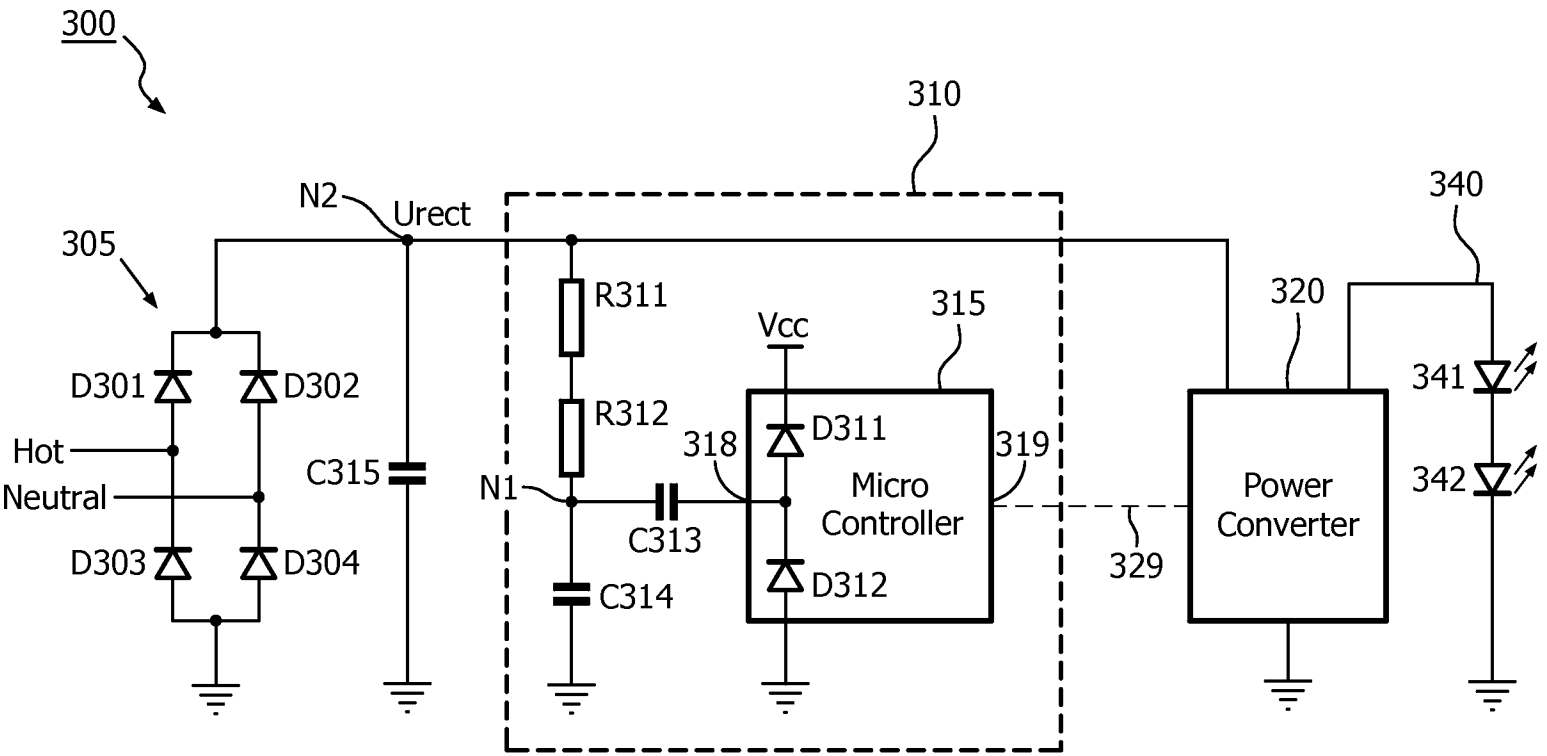
FIG. 3 is a circuit diagram showing a control circuit for a lighting system, according to a representative embodiment.

FIG. 3 is a circuit diagram showing a control circuit for a lighting system, including a dimmer presence detection circuit, a power converter and a solid state lighting fixture, according to a representative embodiment. The general components of FIG. 3 are similar to those of FIG. 2, although more detail is provided with respect to various representative components, in accordance with an illustrative configuration. Of course, other configurations may be implemented without departing from the scope of the present teachings. Referring to FIG. 3, control circuit 300 includes rectification circuit 305 and dimmer presence detection circuit 310 (dashed box). As discussed above with respect to the rectification circuit 205, the rectification circuit 305 is connected directly to the voltage mains or to a dimmer connected between the rectification circuit 305 and the voltage mains to receive unrectified voltage, indicated by the hot and neutral inputs. In the depicted configuration, the rectification circuit 305 includes four diodes D301-D304 connected between rectified voltage node N2 and ground. The rectified voltage node N2 receives the rectified voltage Urect, and is connected to ground through input filtering capacitor C315 connected in parallel with the rectification circuit 305.

Figure 1A:
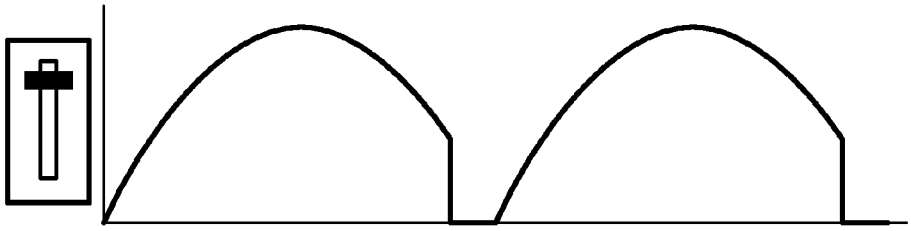
Prior art FIG. 1A
FIGS. 1A-1B show waveforms with and without a dimmer present in a lighting system.
Figure 1B:
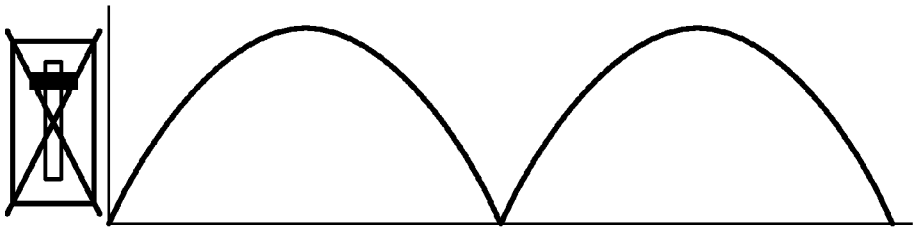
Prior art FIG. 1B

The dimmer presence detection circuit 310 performs a phase angle detection process based on the rectified voltage Urect. When a dimmer is present, a phase angle corresponding to the level of dimming set by the dimmer is detected, based on the extent of phase chopping present in a signal waveform of the rectified voltage Urect (e.g., as shown in FIG. 1A). When a dimmer is not present, there is no phase chopping in the signal waveform (e.g., as shown in FIG. 1B), as indicated by the detected phase angle.

The dimmer presence detection circuit 310 then determines whether a dimmer is present based on the detected phase angle and outputs a power control signal from digital output 319 to power converter 320, the value of which depends on whether a dimmer is present and/or the phase angle of the dimmer. The power converter 320 controls operation of the LED load 340, which includes representative LEDs 341 and 342 connected in series, based on the rectified voltage Urect and the power control signal provided by the dimmer presence detection circuit 310. This allows the dimmer presence detection circuit 310 to adjust selectively the amount of power delivered from the input mains to the LED load 340 based on the detected phase angle and/or the determination of whether a dimmer is present. In various embodiments, the power converter 320 operates in an open loop or feed-forward fashion, as described in U.S. Pat. No. 7,256,554 to Lys, for example, which is hereby incorporated by reference.

In the depicted representative embodiment, the dimmer presence detection circuit 310 includes microcontroller 315, which uses signal waveforms of the rectified voltage Urect to determine the phase angle. The microcontroller 315 includes digital input 318 connected between a first diode D311 and a second diode D312. The first diode D311 has an anode connected to the digital input 318 and a cathode connected to voltage source Vcc, and the second diode 112 has an anode connected to ground and a cathode connected to the digital input 318. The microcontroller 315 also includes the digital output 319.

In various embodiments, the microcontroller 315 may be a PIC12F683 device, available from Microchip Technology, Inc., and the power converter 320 may be an L6562, available from ST Microelectronics, for example, although other types of microcontrollers, power converters, or other processors and/or controllers may be included without departing from the scope of the present teachings. For example, the functionality of the microcontroller 315 may be implemented by one or more processors and/or controllers, connected to receive digital input between first and second diodes D311 and D312 as discussed above, and which may be programmed using software or firmware (e.g., stored in a memory) to perform the various functions described herein, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The dimmer presence detection circuit 310 further includes various passive electronic components, such as first and second capacitors C313 and C314, and a resistance indicated by representative first and second resistors R311 and R312. The first capacitor C313 is connected between the digital input 318 of the microcontroller 315 and a detection node N1. The second capacitor C314 is connected between the detection node N1 and ground. The first and second resistors R311 and R312 are connected in series between the rectified voltage node N2 and the detection node N1. In the depicted embodiment, the first capacitor C313 may have a value of about 560 pF and the second capacitor C314 may have a value of about 10 pF, for example. Also, the first resistor R311 may have a value of about 1 megohm and the second resistor R312 may have a value of about 1 megohm, for example. However, the respective values of the first and second capacitors C313 and C314, and the first and second resistors R311 and R312 may vary to provide unique benefits for any particular situation or to meet application specific design requirements of various implementations, as would be apparent to one of ordinary skill in the art.

The rectified voltage Urect is AC coupled to the digital input 318 of the microcontroller 315. The first resistor R311 and the second resistor R312 limit the current into the digital input 318. When a signal waveform of the rectified voltage Urect goes high, the first capacitor C313 is charged on the rising edge through the first and second resistors R311 and R312. The first diode D311 clamps the digital input 318 one diode drop above the voltage source Vcc, for example, while the first capacitor C313 is charged. The first capacitor C313 remains charged as long as the signal waveform is not zero. On the falling edge of the signal waveform of the rectified voltage Urect, the first capacitor C313 discharges through the second capacitor C314, and the digital input 318 is clamped to one diode drop below ground by the second diode D312. When a trailing edge dimmer is used, the falling edge of the signal waveform corresponds to the beginning of the chopped portion of the waveform. The first capacitor C313 remains discharged as long as the signal waveform is zero. Accordingly, the resulting logic level digital pulse at the digital input 318 closely follows the movement of the chopped rectified voltage Urect, examples of which are shown in FIGS. 4A-4C.

Figure 4A:
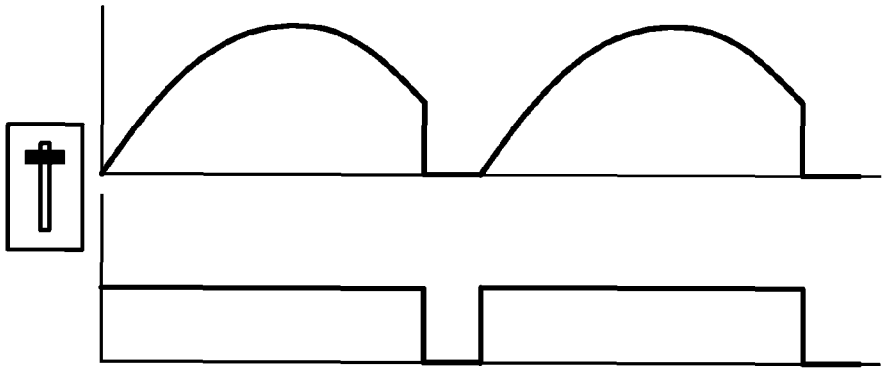
FIGS. 4A-4C show sample waveforms and corresponding digital pulses of a dimmer, according to a representative embodiment.
Figure 4B:
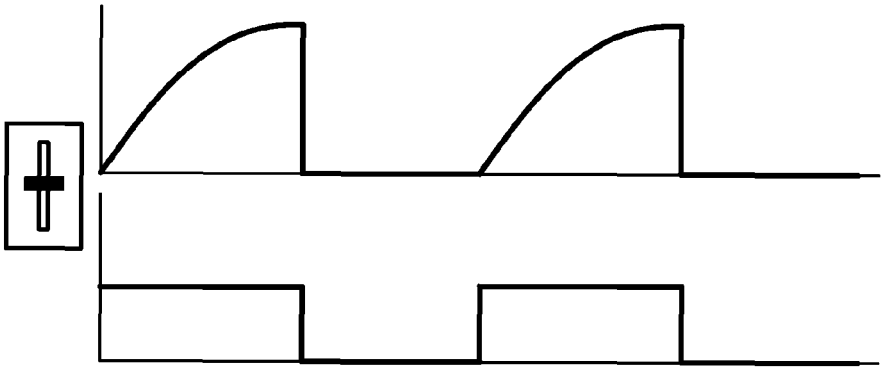
Figure 4C:
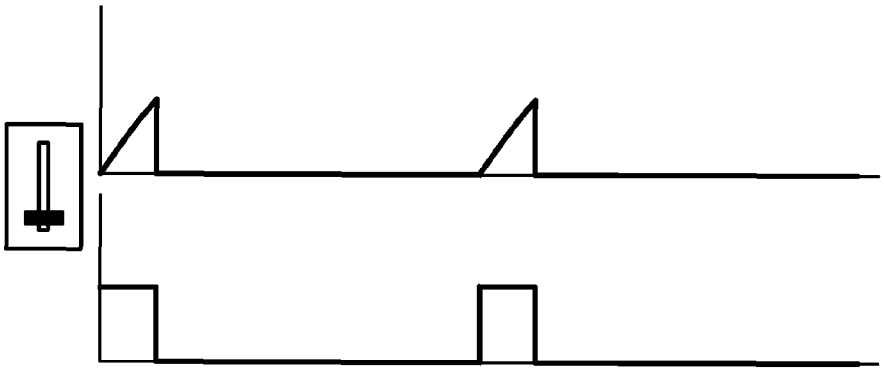

More particularly, FIGS. 4A-4C show sample waveforms and corresponding digital pulses at the digital input 318, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input 318 of the microcontroller 315. Notably, the length of each digital pulse corresponds to a chopped waveform, and thus is equal to the amount of time the dimmer's internal switch is "on." By receiving the digital pulses via the digital input 318, the microcontroller 315 is able to determine the level to which the dimmer has been set.

FIG. 4A shows sample waveforms of rectified voltage Urect and corresponding digital pulses when the dimmer is at its highest setting, indicated by the top position of the dimmer slider shown next to the waveforms. FIG. 4B shows sample waveforms of rectified voltage Urect and corresponding digital pulses when the dimmer is at a medium setting, indicated by the middle position of the dimmer slider shown next to the waveforms. FIG. 4C shows sample waveforms of rectified voltage Urect and corresponding digital pulses when the dimmer is at its lowest setting, indicated by the bottom position of the dimmer slider shown next to the waveforms.

Figure 5:
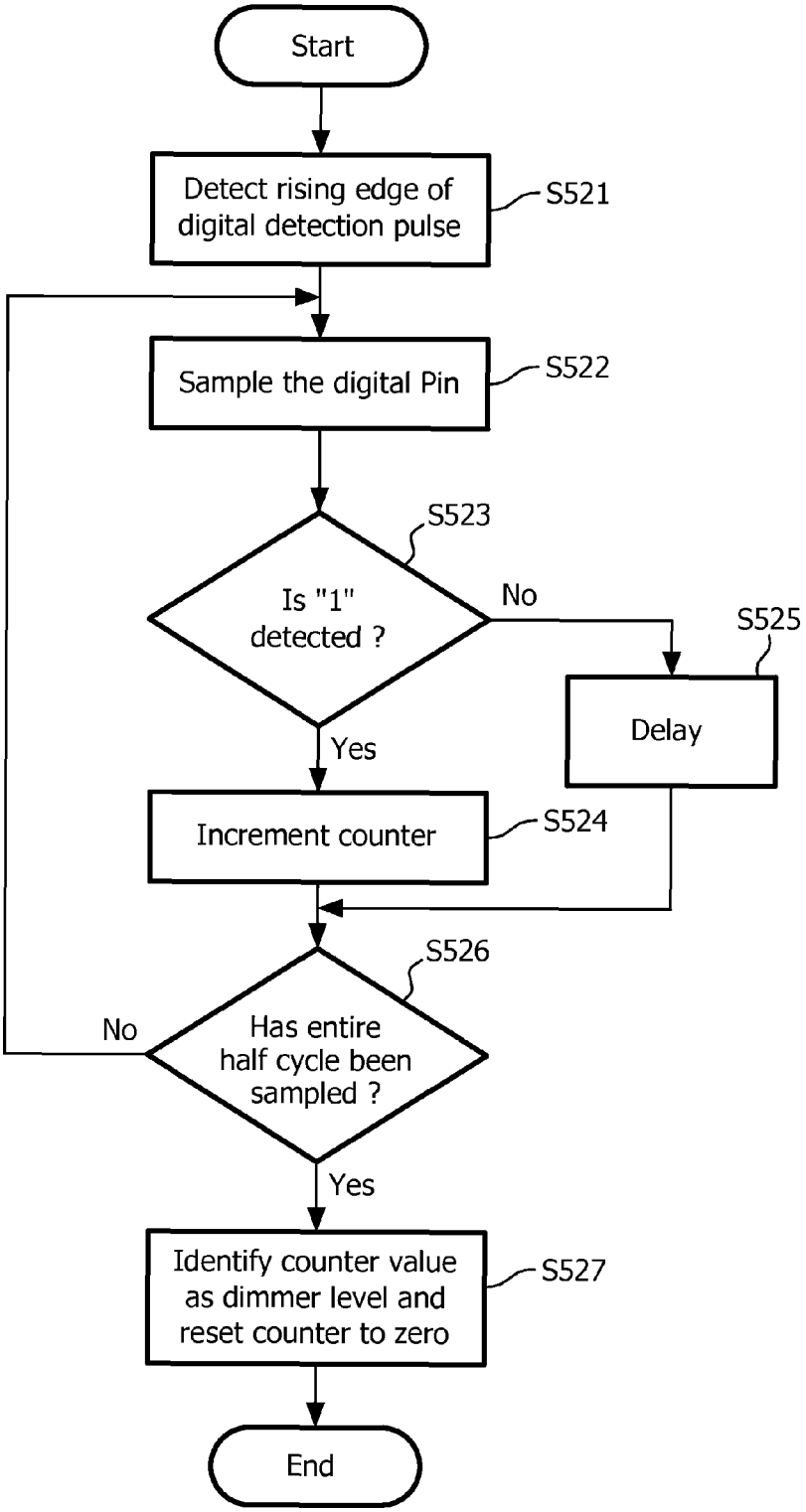
FIG. 5 is a flow diagram showing a process of detecting phase angles, according to a representative embodiment.

FIG. 5 is a flow diagram showing a process of detecting the phase angle of a dimmer, according to a representative embodiment. The process may be implemented by firmware and/or software executed by the microcontroller 315 shown in FIG. 3, or more generally by a processor or controller, e.g., the dimmer presence detection circuit 210 shown in FIG. 2, for example.

In block S521 of FIG. 5, a rising edge of a digital pulse of an input signal (e.g., indicated by rising edges of the bottom waveforms in FIGS. 4A-4C) is detected, for example, by initial charging of the first capacitor C313. Sampling at the digital input 318 of the microcontroller 315, for example, begins in block S522. In the depicted embodiment, the signal is sampled digitally for a predetermined time equal to just under a mains half cycle. Each time the signal is sampled, it is determined in block S523 whether the sample has a high level (e.g., digital "1") or a low level (e.g., digital "0"). In the depicted embodiment, a comparison is made in block S523 to determine whether the sample is digital "1." When the sample is digital "1" (block S523: Yes), a counter is incremented in block S524, and when the sample is not digital "1" (block S523: No), a small delay is inserted in block S525. The delay is inserted so that the number of clock cycles (e.g., of the microcontroller 315) is equal regardless of whether the sample is determined to be digital "1" or digital "0."

In block S526, it is determined whether the entire mains half cycle has been sampled. When the mains half cycle is not complete (block S526: No), the process returns to block S522 to again sample the signal at the digital input 318. When the mains half cycle is complete (block S526: Yes), the sampling stops and the counter value accumulated in block S524 is identified as the current phase angle in block S527, and the counter is reset to zero. The counter value may be stored in a memory, examples of which are discussed above. The microcontroller 315 may then wait for the next rising edge to begin sampling again.

Figure 6:
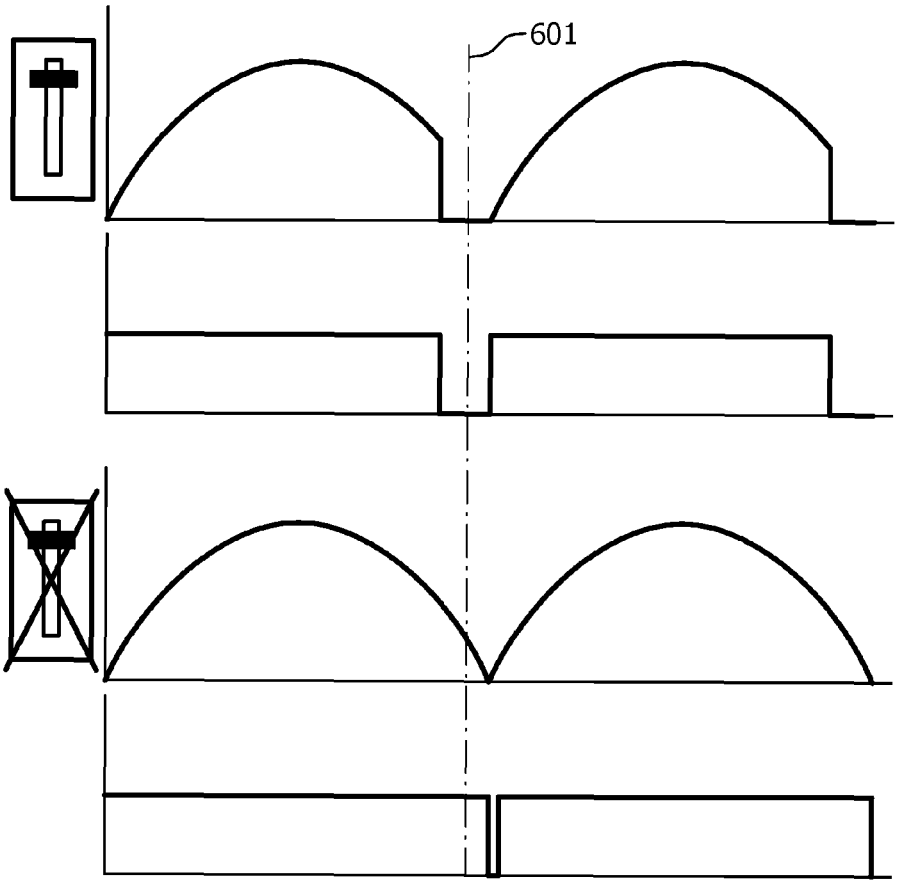
FIG. 6 shows sample waveforms and corresponding digital pulses of a lighting system with and without a dimmer, according to a representative embodiment.

For example, it may be assumed that the microcontroller 315 takes 255 samples during a mains half cycle. When the dimming level or phase angle is set by the slider at or near the top of its range (e.g., as shown in FIG. 4A and FIG. 6), the counter will increment to about 255 in block S524 of FIG. 5. When the dimming level is set by the slider near the bottom of its range (e.g., as shown in FIG. 4C), the counter will increment to only about 10 or 20 in block S524. When the dimming level is set somewhere in the middle of its range (e.g., as shown in FIG. 4B), the counter will increment to about 128 in block S524. The value of the counter thus gives the microcontroller 315 an accurate indication of the level to which the dimmer has been set or the phase angle of the dimmer. In various embodiments, the phase angle may be calculated, e.g., by the microcontroller 315, using a predetermined function of the counter value, where the function may vary in order to provide unique benefits for any particular situation or to meet application specific design requirements of various implementations, as would be apparent to one of ordinary skill in the art.

Accordingly, the phase angle may be electronically detected, using minimal passive components and a digital input structure of a microcontroller (or other processor or controller circuit). In an embodiment, the phase angle detection is accomplished using an AC coupling circuit, a microcontroller diode clamped digital input structure and an algorithm (e.g., implemented by firmware, software and/or hardware) executed to determine the dimmer setting level. Additionally, the condition of the dimmer may be measured with minimal component count and taking advantage of the digital input structure of a microcontroller.

FIG. 6 shows sample waveforms and corresponding digital pulses of a lighting system with and without a dimmer, according to a representative embodiment. Referring to FIG. 6, the top set of waveforms shows the rectified input mains voltage and the corresponding detected logic level digital pulses with a dimmer connected (indicated by the adjacent dimmer switch). The top set of waveforms depicted in FIG. 6 is similar to the set of waveforms depicted in FIG. 4A, where the dimmer is at its highest setting. The bottom set of waveforms in FIG. 6 shows the rectified input mains voltage and the corresponding logic level digital pulses without a dimmer connected (indicated by an "X" through the adjacent dimmer switch). The dashed line 601 indicates a representative upper level threshold corresponding to presence of the dimmer. The upper level threshold may be determined by various means, including empirically measuring an "on" time of the dimmer at its highest setting, retrieving the "on" time from a manufacturer database, or the like.

As discussed above, a phase chopping dimmer does not allow the full rectified mains voltage sine wave through, but rather chops a section of each waveform, even at its highest setting, as shown in the top set of waveforms. In comparison, without a dimmer connected, the full rectified mains voltage sine wave is able to pass, as shown in the bottom set of waveforms. For example, if the digital pulse, as determined by the dimmer presence detection circuit 310, does not extend beyond the upper level threshold (as shown in the top set of waveforms), it is determined that a dimmer is present. If the digital pulse extends beyond the upper level threshold (as shown in the bottom set of waveforms), it is determined that a dimmer is not present.

Figure 7:
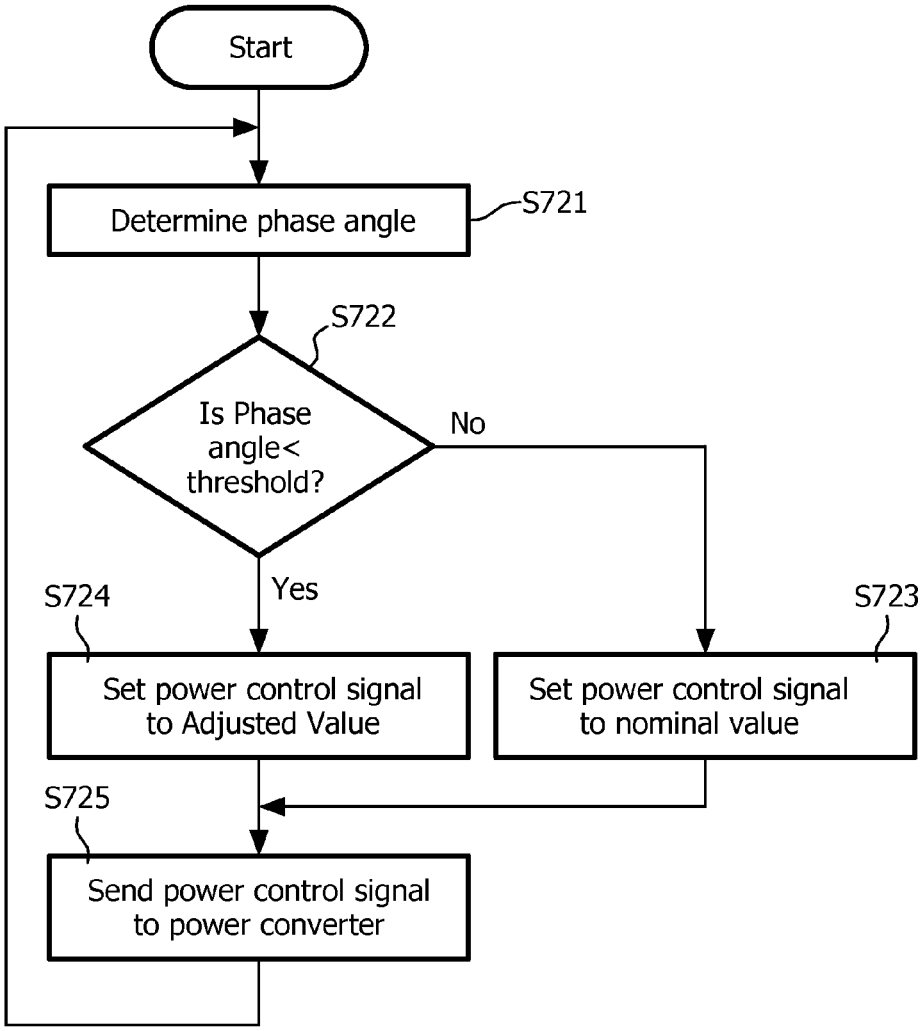
FIG. 7 is a flow diagram showing a process of controlling an amount of power delivered by a power converter to a solid state lighting load, according to a representative embodiment.

FIG. 7 is a flow diagram showing a process of controlling an amount of power delivered by a power converter to a solid state lighting load, according to a representative embodiment. The process may be implemented, for example, by firmware and/or software executed by the microcontroller 315 of FIG. 3, or more generally by a processor or controller, e.g., the dimmer presence detection circuit 210 shown in FIG. 2, for example.

In block S721, the phase angle is determined. For example, the phase angle may be detected according to the algorithm depicted in FIG. 5 or retrieved from memory (e.g., in which the phase angle information was stored in block S527). It is determined in block S722 whether the phase angle (e.g., the length of the digital pulse) is less than a predetermined threshold (e.g., upper level threshold 501). Of course, in alternative embodiments, it may be determined whether the retrieved phase angle is greater than (as opposed to less than) the upper level threshold, without departing from the scope of the present teachings.

In the depicted embodiment, when the phase angle is determined not to be less than (e.g., greater than) the upper level threshold (block S722: No), this indicates that a dimmer is not present in the circuit. Therefore, the voltage input to the power converter 320 is the same as the (rectified) mains input voltage. Accordingly, the dimmer presence detection circuit 310 sets the power control signal to a predetermined nominal value in block S723 and sends the power control signal to the power converter 320 in block S725. In response, the operating point of the power converter 320 is set so that the power converter 320 delivers the nominal power to the LED load 340 corresponding to the mains input voltage.

When the phase angle is determined to be less than the upper level threshold (block S722: Yes), this indicates that a dimmer is present in the circuit. Therefore, without compensation, the voltage input to the power converter 320 would be less than the (rectified) mains input voltage. Accordingly, the dimmer presence detection circuit 310 sets the power control signal to a predetermined adjusted value in block S724 and sends the power control signal to the power converter 320 in block S725. In response, the operating point of the power converter 320 is adjusted so that the power converter 320 adds a compensation amount to the power corresponding to the input voltage to the power converter 320. The compensation amount compensates for the power loss resulting from the decrease in the mains input voltage seen by the power converter 320 due to the dimmer. Thus, the power converter 320 delivers an increased power to the LED load 340 that is the same as the nominal power corresponding to the mains input voltage, so that the power delivered to the LED load 340 is the same as when a dimmer is not present.

The compensation amount and the adjusted value of the power control signal may be determined empirically at the design and/or manufacturing stage. For example, the power to the LED load 340 may be measured with and without a dimmer in the circuit, where the dimmer is set to the highest setting (i.e., the least amount of dimming and thus the highest level of light output). The compensation amount is the difference between the measured power to the LED load 340 with and without a dimmer. The microcontroller 315 may then be programmed to generate a power control signal to control the operating point of the power converter 320 for delivering the additional compensation amount when a dimmer is detected. Alternatively, the compensation amount and the adjusted value of the power control signal may be determined theoretically, as would be apparent to one of ordinary skill in the art, without departing from the scope of the present teachings.

Accordingly, the presence or absence of a dimmer may be electronically detected, using minimal passive components and a digital input structure of a microcontroller (or other processor or processing circuit). In an embodiment, dimmer detection is accomplished using an AC coupling circuit, a microcontroller diode clamped digital input structure and an algorithm (e.g., implemented by firmware, software and/or hardware) executed for binary determination of dimmer presence.

The dimmer presence detection circuit and associated algorithm may be used in various situations where it is desired to know whether or not an electronic transformer is connected as the load of a phase chopping dimmer, for example. Once the presence or absence of a dimmer has been determined, compatibility with dimmers with respect to solid state lighting fixtures (e.g. LEDs) may be improved. Examples of such improvements include compensating for high end power loss due to a dimmer's full "on" phase chop, increasing efficiency by shutting off all unnecessary functions if a dimmer is not present, and switching in a bleeding load to help a dimmer's minimum load requirement if a dimmer is present.

In various embodiments, the dimmer presence detection circuit and associated algorithm may be further used in situations where it is further desired to know the exact phase angle of a phase chopping dimmer, i.e., once it has been determined that a dimmer is present. For example, electronic transformers which run as a load to a phase chopping dimmer can use this circuit and method to determine the phase angle. Once the phase angle is known, the range of dimming and compatibility with dimmers with respect to solid state lighting fixtures (e.g. LEDs) may be improved. Examples of such improvements include controlling the color temperature of a lamp with dimmer setting, determining the minimum load a dimmer can handle in situ, determining when a dimmer behaves erratically in situ, increasing maximum and minimum ranges of light output, and creating custom dimming light to slider position curves.

Generally, the high end power loss correction and algorithm, according to various embodiments, may be used in situations where a dimmable electronic ballast is either connected to a dimmer or directly to the voltage mains, and it is desired to have the same light output at the high end of the dimmer as when the ballast is connected directly to the voltage mains without a dimmer. In various embodiments, the functionality of the microcontroller 315, for example, may be implemented by one or more processing circuits, constructed of any combination of hardware, firmware or software architectures, and may include its own memory (e.g., nonvolatile memory) for storing executable software/firmware executable code that allows it to perform the various functions. For example, the functionality may be implemented using ASICs, FPGAs, and the like.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used.

Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, reference numerals, if any, are provided in the claims merely for convenience and are not to be interpreted in any way as limiting the claims.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A method of controlling an amount of power delivered by a power converter to a solid state lighting load, the method comprising:

determining whether a dimmer is present between a voltage source and the power converter based on a rectified input voltage from the voltage source, wherein the determining includes:

obtaining, from a digital input coupled to a capacitor that is coupled to the rectified input voltage, a plurality of digital samples during a predetermined time interval, incrementing a counter for each of the plurality of digital samples that has a predetermined level, identifying a value of the counter at the end of the predetermined time interval as a detected phase angle of the rectified input voltage, and comparing the detected phase angle to a predetermined threshold, wherein the dimmer is determined to be present when the detected phase angle is less than the predetermined threshold, and the dimmer is determined to be absent when the detected phase angle is not less than the predetermined threshold; and when the dimmer is determined to be present, adjusting an operating point of the power converter to increase the amount of power delivered by the power converter to the solid state lighting load by a compensation amount, so that the increased amount of power is equal to an amount of power delivered by the power converter when the dimmer is not present.

2. The method of claim 1, wherein the step of adjusting the operating point of the power converter comprises setting a power control signal to a predetermined adjusted value corresponding to the increased amount of power to be delivered by the power converter, wherein the adjusted value comprises a pulse width modulation (PWM) signal having a first duty cycle.

3. The method of claim 1, further comprising maintaining a nominal operating point of the power converter when the dimmer is determined not to be present.

4. The method of claim 3, wherein the step of maintaining the operating point of the power converter comprises:

setting the power control signal to a predetermined nominal value corresponding to the amount of power to be delivered by the power converter when the dimmer is not present.

5. The method of claim 4, wherein the nominal value comprises a PWM signal having a second duty cycle.

6. A system for controlling power delivered to a solid state lighting load, the system comprising:

a power converter configured to deliver a predetermined nominal power to the solid state light load in response to a rectified input voltage originating from voltage mains; and a dimmer presence detection circuit comprising:

a processor comprising a digital input;

a first diode connected between the digital input and the voltage mains;

a second diode connected between the digital input and ground;

a first capacitor connected between the digital input and a detection node;

a second capacitor connected between the detection node and ground; and a resistance connected between the detection node and a rectified voltage node, which receives the rectified input voltage;

wherein the processor is configured to sample digital pulses at the digital input based on the rectified input voltage and to detect a phase angle based on lengths of the sampled digital pulses;

wherein the dimmer presence detection circuit is configured to determine whether a dimmer is connected between the voltage mains and the power converter, to generate a power control signal having a first value when the dimmer is present and having a second value when the dimmer is not present, and to provide the power control signal to the power converter, wherein the dimmer presence detection circuit determines whether the dimmer is connected by detecting the phase angle, comparing the detected phase angle with a predetermined threshold, and determining that the dimmer is present when the detected phase angle is less than the threshold;

wherein the power converter increases output power by a compensation amount in response to the first value of the power control signal, the increased output power being equal to the nominal power.

7. The system of claim 6, wherein the power converter does not increase the output power in response to the second value of the power control signal, the output power being equal to the nominal power.

8. The system of claim 7, wherein the first value of the power control signal comprises a pulse width modulation (PWM) signal having a first duty cycle, and the second value of the power control signal comprises a PWM signal having a second duty cycle different from the first duty cycle.

9. The system of claim 8, wherein the first duty cycle comprises a 100 percent duty cycle, and the second duty cycle comprises a 0 percent duty cycle.

10. The system of claim 6, wherein the first capacitor is charged though the resistance on a rising edge of a signal waveform of the rectified input voltage, and the first diode clamps the digital input pin one diode drop above the voltage mains when the first capacitor is charged, providing a digital pulse having a length corresponding to the signal waveform, and wherein the first capacitor discharges through the second capacitor on a falling edge of the signal waveform, and the second diode clamps the digital input pin one diode drop below ground when the first capacitor is discharged.

11. A method of controlling a power converter to deliver a predetermined nominal power to a light-emitting diode (LED) light source corresponding to an input voltage from voltage mains, regardless of whether a dimmer is present in a circuit between the voltage mains and the power converter, the method comprising:

detecting a phase angle based on signal waveforms of a rectified input voltage, wherein detecting the phase angle comprises:

obtaining, from a digital input coupled to a capacitor that is coupled to the rectified input voltage, a plurality of digital samples during a predetermined time interval, incrementing a counter for each of the plurality of digital samples that has a predetermined level, and identifying a value of the counter at the end of the predetermined time interval as the detected phase angle;

comparing the detected phase angle with a predetermined threshold;

when the detected phase angle is below the predetermined threshold, setting a power control signal to a dimmer value and providing the power control signal to the power converter, causing the power converter to increase an output power to the predetermined nominal power and to deliver the increased output power to the LED light source; and when the detected phase angle is not below the predetermined threshold, setting the power control signal to a no dimmer value and providing the power control signal to the power converter, causing the power converter to deliver an output power to the LED light source without increasing the output power, the output power being equal to the predetermined nominal power.

* * * * *